US007086966B2

(12) United States Patent
Ohama et al.

(10) Patent No.: US 7,086,966 B2
(45) Date of Patent: Aug. 8, 2006

(54) GOLF BALL

(75) Inventors: Keiji Ohama, Kobe (JP); Seiichiro Endo, Kobe (JP)

(73) Assignee: SRI Sports Limited, Kobe Hyogo (JP)

( * ) Notice: Subject to any disclaimer, the term of this patent is extended or adjusted under 35 U.S.C. 154(b) by 0 days.

(21) Appl. No.: 10/353,027

(22) Filed: Jan. 29, 2003

(65) Prior Publication Data

US 2003/0148826 A1 Aug. 7, 2003

(30) Foreign Application Priority Data

Feb. 6, 2002 (JP) ..... 2002-029919

(51) Int. Cl.
*A63B 37/04* (2006.01)
*A63B 37/06* (2006.01)
*A63B 37/08* (2006.01)

(52) U.S. Cl. ..... 473/374; 473/370

(58) Field of Classification Search ..... 473/351–377
See application file for complete search history.

(56) References Cited

U.S. PATENT DOCUMENTS 5,407,998 A * 4/1995 Horiuchi et al. ..... 525/133
5,779,562 A 7/1998 Melvin et al.
5,967,907 A * 10/1999 Takemura et al. ..... 473/373
6,361,453 B1 3/2002 Nakamura et al.

FOREIGN PATENT DOCUMENTS

| | | |
|---|---|---|
| JP | 61-94666 A | 5/1986 |
| JP | 6-91019 A | 4/1994 |
| JP | 7-185039 A | 7/1995 |
| JP | 2000-51402 | 2/2000 |
| JP | 2001-29511 A | 2/2001 |

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

Golf ball 1 has a core 2, a mid layer 3 and a cover 4. The mid layer 3 is composed of a matrix of which base material is a rubber or a synthetic resin, and solid particles which are dispersed in the matrix. Hardness (Shore D) Hm of the matrix is greater than hardness Hg of the solid particles. Difference between both hardness (Hm−Hg) is 5 or greater. Particle size D of the solid particles is 0.5 mm or greater. A ratio "D/T", i.e., a ratio of the particle size D to the thickness T of the mid layer is 0.1 or greater. A proportion of the solid particles occupied in the mid layer 3 is 3% by weight or greater and 40% by weight or less. Hardness Hm of the matrix is 30 or greater. Hardness Hg of the solid particle is 40 or less.

7 Claims, 2 Drawing Sheets

GOLF BALL

BACKGROUND OF THE INVENTION

1. Field of the Invention

The present invention relates to golf balls. More particularly, the present invention relates to solid golf balls having a core, mid layer and a cover.

2. Description of the Related Art

Golf balls used for playing golf at a golf course are generally classified into: wound golf balls having a core comprising wound rubber threads; and solid golf balls having a core comprising a solid rubber. Wound golf balls have been conventionally used, with a period during which the wound golf balls account for almost all of the first-class golf balls. However, solid golf balls that have been developed afterwards can be readily manufactured at a lower cost, therefore, larger number of solid golf balls have been recently supplied to the market than the wound golf balls. In general, solid golf balls have drawbacks in a feel at impact being hard compared to wound golf balls. To the contrary, common solid golf balls are more excellent in-terms of a travel distance than wound golf balls. In an attempt to improve a feel at impact and to further enhance a flight performance, solid golf balls including a mid layer between a core and a cover have been proposed and placed on the market.

Meanwhile, a variety of techniques have been proposed where particles (solids) comprising a crosslinked rubber or a synthetic resin are blended in a core of a solid golf ball. For example, a core blended with particles of ebonite that is a highly hard rubber is disclosed in Japanese Patent Publication Reference JP-A-94666/1986. In Japanese Patent Publication Reference JP-A-91019/1994, there is disclosed a core blended with high molecular weight polyethylene (trade name: "Miperon XM220") having a Shore D hardness of about 65. In Japanese Patent Publication Reference JP-A-185039/1995, there is disclosed a golf ball with mitigated impulsive force at impact through blending vulcanized rubber powder having a particle diameter of from 0.8 mm to 7.0 mm in a core. In Japanese Patent Publication Reference JP-A-314342/1998, there is disclosed a golf ball having a central core layer, an outer core layer, an inner cover layer (This inner cover layer can be also assumed as an outermost layer of the core.) and an outer cover layer, wherein polypropylene powder is blended in the core.

In Japanese Patent Publication Reference JP-A-583/2001, there is disclosed a golf ball having a core blended with particles of which hardness being higher than the hardness of the core surface. In Japanese Patent Publication Reference JP-A-584/2001, there is disclosed a golf ball having a core blended with particles of which difference from the core being small in their specific gravity. In Japanese Patent Publication Reference JP-A-587/2001, there is disclosed a golf ball having a core blended with particles, without exposure of these particles to the core surface. Japanese Patent Publication Reference JP-A-29511/2001 discloses a golf ball having a mid layer including rubber particles dispersed in a thermoplastic resin.

Even with these golf balls including particles blended therein, concomitant achievement of favorable flight performance and soft feel at impact has not been enabled. The present invention was made taking into account of such circumstances, and an object of the present invention is to provide golf balls which are excellent in both respects of the flight performance and feel at impact.

SUMMARY OF THE INVENTION

A golf ball according to the present invention has a core, a mid layer and a cover. This mid layer includes a matrix of which base material is a rubber or a synthetic resin, and solid particles which are dispersed in this matrix and have a particle size D of 0.5 mm or greater. When it is assumed that Shore D hardness of this matrix be Hm and Shore D hardness of the solid particle be Hg, a value (Hm−Hg) is 5 or greater.

The mid layer of this golf ball includes solid particles having relatively low hardness and large diameter. This solid particle contributes to softening of the feel at impact of the golf ball. The matrix of this mid layer has relatively high hardness. This matrix contributes to the improvement of a flight performance.

A ratio "D/T", i.e., a ratio of the particle size D of the solid particle to the thickness T of the mid layer is preferably 0.1 or greater. Blending the solid particle results in further improvement of the feel at impact of the golf ball.

A proportion of the solid particles occupied in the mid layer is preferably 3% by weight or greater and 40% by weight or less. In accordance with the golf ball having this mid layer achieves an extremely superior feel at impact and a long travel distance.

In light of the flight performance, it is preferred that Shore D hardness of the matrix be 30 or greater. Moreover, in light of the feel at impact, solid particles having Shore D hardness Hg of 40 or less are preferred.

DESCRIPTION OF THE PREFERRED EMBODIMENTS

The present invention is hereinafter described in detail with appropriate references to the accompanying drawing according to the preferred embodiments of the present invention.

Figure 1:
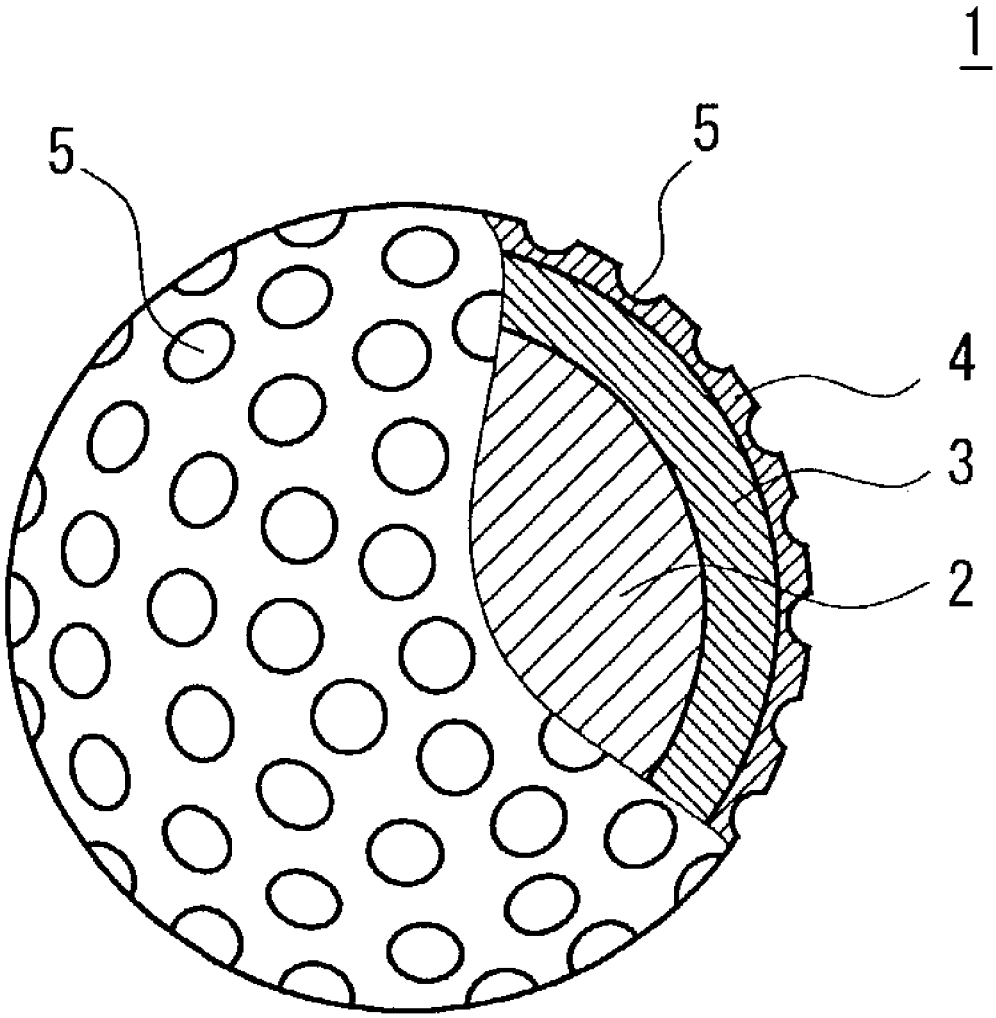
FIG. 1 is a cross-sectional view with a partially cut off part illustrating a golf ball according to one embodiment of the present invention.

A golf ball 1 depicted in FIG. 1 has a core 2, a mid layer 3 and a cover 4. Numerous dimples 5 are formed on the surface of the cover 4. This golf ball 1 has a paint layer and a mark layer on the outer face of the cover 4. although not shown in the Figure. This golf ball 1 has a diameter of from 40 mm to 45 mm, and in particular, of from 42 mm to 44 mm. In light of the reduction of air resistance in the range to comply with a rule defined by United States Golf Association (USGA), the diameter is preferably 42.67 mm or greater and 42.80 mm or less. Weight of this golf ball 1 is 40 g or greater and 50 g or less, and particularly 44 g or greater and 47 g or less. In light of the elevation of inertia in the range to comply with a rule defined by United States Golf Association, the golf ball 1 preferably has a weight of 45.00 g or greater and 45.93 g or less.

Figure 2:
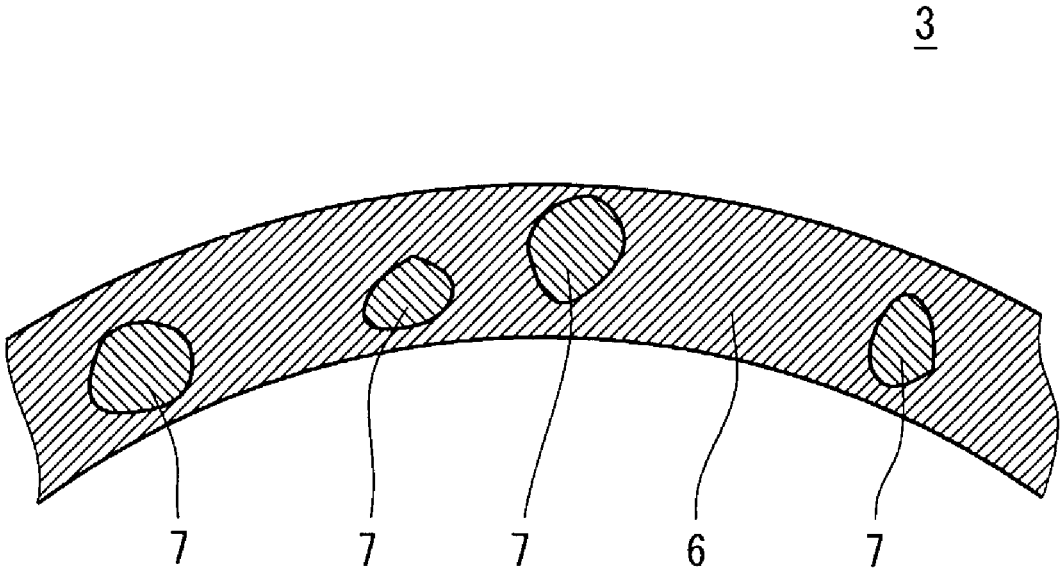
FIG. 2 is an enlarged cross-sectional view illustrating a part of a mid layer of the golf bell shown in FIG. 1.

FIG. 2 is an enlarged cross-sectional view illustrating a part of the mid layer 3 of the golf ball 1 shown in FIG. 1. The mid layer 3 includes a matrix 6 of which base material is a rubber or a synthetic resin, and solid particles 7 dispersed in this matrix 6. Hardness Hm of the matrix 6 is greater than hardness Hg of the solid particles 7. Difference between both hardness (Hm−Hg) is 5 or greater. In other words, the mid layer 3 is composed of a matrix 6 having relatively high hardness and solid particles 7 having relatively low hardness. Hardness is measured in accordance with a standard of "ASTM-D 2240-68", with Shore D type spring hardness scale. When the sample to be measured consists of a resin composition, hardness is measured with a slab molded from this resin composition. When the sample to be measured consists of a rubber composition to be crosslinked, hardness is measured with a slab prepared by crosslinking the rubber composition under the identical condition of a subject crosslinking condition.

By employing a matrix 6 having high hardness, a resilience performance of the golf ball 1 is improved. In addition, a launch angle of the golf ball 1 is increased by employing a matrix 6 having high hardness, thereby optimizing a trajectory. On behalf of the excellent resilience performance and optimized trajectory, the travel distance of the golf ball 1 is increased. Although detailed grounds for the increased launch angle by employing the matrix 6 having high hardness are not clear, it is suspected that it may result from the event of transfer of the deformation at a micro level upon impact close to the central part of the golf ball 1.

In light of the flight performance, hardness Hm of the matrix 6 is preferably 30 or greater, more preferably 35 or greater, and particularly preferably 40 or greater. When hardness Hm of the matrix 6 is too high, improvement of the feel at impact may become difficult even though solid particles 7 having a low hardness are blended, and thus hardness Hm is preferably 70 or less, and particularly preferably 68 or less.

By means of solid particles 7 having low hardness, the feel at impact of the golf ball 1 becomes soft even though the matrix 6 has high hardness. In other words, an excellent flight performance and a soft feel at impact are both accomplished concurrently by the matrix 6 having high hardness and the solid particles 7 having low hardness. Although detailed grounds for rendering the feel at impact soft by solid particles 7 having low hardness, it is suspected that it may result from the event of local deformation of a part of the mid layer 3 (i.e., solid particles 7) upon impact.

In light of the feel at impact, hardness Hg of the solid particles 7 is preferably 40 or less, more preferably 35 or less, even more preferably 30 or less, and particularly preferably 25 or less. When hardness Hg of the solid particles 7 is too low, durability of the golf ball 1 may become insufficient, and thus hardness Hg of the solid particles 7 is preferably 3 or greater, more preferably 5 or greater, and particularly preferably 10 or grater.

Difference between hardness Hm of the matrix 6 and hardness Hg of the solid particles 7, i.e., (Hm−Hg) is 5 or greater as described herein above. Accordingly, an excellent flight performance and a soft feel at impact are both accomplished concurrently. In this respect, the difference (Hm−Hg) is preferably 10 or greater, and particularly preferably 15 or greater. When the difference (Hm−Hg) is too large, deteriorated feel at impact resulting from the matrix 6 may be significant, or alternatively, reduced durability resulting from the solid particles 7 may be significant. Therefore, it is preferred that the difference (Hm−Hg) be 50 or less.

The mid layer 3 includes solid particles 7 having a particle size D of 0.5 mm or greater, i.e., solid particles 7 having a large diameter. The solid particles 7 having a large diameter improve the feel at impact of the golf ball 1. In this respect, solid particles 7 having a particle size D of 0.7 mm or greater are more preferable, and solid particles 7 having a particle size D of 0.9 mm or greater are particularly preferable. Upper limit of the particle size D is determined on the basis of the relation with the thickness T of the mid layer 3 described herein after. Solid particles 7 having a particle size D of 0.5 mm or greater and solid particles 7 having a particle size D of 0.5 mm or less may be mixed together. The particle size D is measured in conformity with the regulation of "JIS K 6316" using a sieve specified in "JIS Z 8801".

It is preferred that the mid layer 3 includes solid particles 7 having a ratio "D/T", i. e., a ratio of the particle size D to the thickness T of the mid layer 3, being 0.1 or greater. This solid particle 7 improves the feel at impact of the golf ball 1. In this respect, solid particles 7 having a ratio "D/T" of 0.2 or greater are more preferred, and solid particles 7 having a ratio "D/T" of 0.3 or greater are particularly preferred. When the ratio "D/T" is too large, the solid particles 7 are exposed out of the inner side surface or outer side surface of the mid layer 3. Therefore, solid particles 7 having the ratio "D/T" of 1.1 or less are preferred, and solid particles 7 having the ratio "D/T" of 0.9 or less are particularly preferred. Solid particles 7 having the ratio "D/T" of 0.1 or greater and solid particles 7 having the ratio "D/T" of 0.1 or less may be mixed together. The thickness T of the mid layer 3 is usually 0.3 mm or greater and 7.0 mm or less, and particularly, 0.5 mm or greater and 5.0 mm or less.

It is preferred that a proportion of the solid particles 7 occupied in the mid layer 3 be 3% by weight or greater and 40% by weight or less. When the proportion is less than the above range, the improvement of the feel at impact may become insufficient. In this respect, the proportion is preferably 5% by weight or greater, and particularly preferably 10% by weight or greater. When the proportion is beyond the above range, the resilience performance of the golf ball 1 may become insufficient. In this respect, the proportion is preferably 30% by weight or less, and particularly preferably 25% by weight or less.

When the solid particles 7 having a particle size D of 0.5 mm or greater and the solid particles 7 having a particle size D of 0.5 mm or less are admixed together, it is preferred that the proportion of the solid particles 7 having a particle size D of 0.5 mm or greater occupied in the mid layer 3 be 5% by weight or greater, and particularly 10% by weight or greater. When the solid particles 7 having a particle size D of 0.5 mm or greater and the solid particles 7 having a particle size D of 0.5 mm or less are admixed together, it is preferred that the proportion of a total amount of the solid particles 7 occupied in the mid layer 3 be 40% by weight or less, even more 30% by weight or less, and particularly 25% by weight or less.

When the solid particles 7 having a ratio "D/T" of 0.1 or greater and the solid particles 7 having a ratio "D/T" of 0.1 or less are admixed together, it is preferred that the proportion of the solid particles 7 having a ratio "D/T" of 0.1 or greater occupied in the mid layer 3 be 3% by weight or greater, even more 5% by weight or greater, and particularly 10% by weight or greater. When the solid particles 7 having a ratio "D/T" of 0.1 or greater and the solid particles 7 having a ratio "D/T" of 0.1 or less are admixed together, it is preferred that the proportion of a total amount of the solid particles 7 occupied in the mid layer 3 be 40% by weight or less, even more 30% by weight or less, and particularly 25% by weight or less.

The matrix 6 includes a rubber or a synthetic resin as a base material. In general, the matrix 6 can be obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In view of the resilience performance, polybutadienes are preferred. Even in the case where another rubber is used in combination with a polybutadiene, to employ a polybutadiene as a predominant component is preferred. More specifically, it is preferred that a proportion of polybutadiene occupied in total base rubber be 50% by weight or greater, and particularly 80% by weight or greater. Among polybutadienes, high cis-polybutadienes are preferred, which have a percentage of cis-1, 4-bond of 40% or greater, and particularly 80% or greater.

Mode of crosslinking in the matrix 6 is not particularly limited. Crosslinking agents which can be used include co-crosslinking agents, organic peroxides, sulfur and the like. For the ground that the resilience performance can be improved, it is preferred that co-crosslinking agents and organic peroxides are used in combination. Preferable co-crosslinking agents in view of the resilience performance include monovalent or divalent metal salts of α,β-unsaturated carboxylic acid having 2 to 8 carbon atoms. Specific examples of the preferable co-crosslinking agent include zinc acrylate, magnesium acrylate, zinc methacrylate and magnesium methacrylate. In particular, zinc acrylate is preferred which can result in a high resilience performance.

As a co-crosslinking agent, α,β-unsaturated carboxylic acid having 2 to 8 carbon atoms, and oxidized metal may be blended. Both components react in the rubber composition to give a salt. Preferable α,β-unsaturated carboxylic acids include acrylic acid and methacrylic acid, and in particular, acrylic acid is preferred. Preferable metal oxide includes an oxide of zinc and an oxide of magnesium, and in particular, an oxide of zinc is preferred.

The amount of the co-crosslinking agent to be blended is preferably 10 parts (by weight) or greater and 40 parts or less per 100 parts of the base rubber. When the amount to be blended is less than the above range, the resilience performance or durability of the golf ball 1 may become insufficient. In this respect, the amount to be blended is preferably 15 parts or greater, and particularly preferably 20 parts or greater. When the amount to be blended is beyond the above range, the matrix 6 may be so hard that the feel at impact may not be improved even though the solid particles 7 are blended. In this respect, the amount to be blended is preferably 35 parts or less, and particularly preferably 30 parts or less.

In the rubber composition for use in the matrix 6, an organic peroxide may be preferably blended. The organic peroxide serves as a crosslinking agent in conjunction with the above-mentioned metal salt of α,β-unsaturated carboxylic acid, and also serves as a curing agent. By blending the organic peroxide, the resilience performance of the golf ball 1 maybe improved. Suitable organic peroxide includes dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part or greater and 3.0 parts or less per 100 parts of the base rubber. When the amount to be blended is less than the above range, the matrix 6 may be so soft that the resilience performance of the golf ball 1 may become insufficient. In this respect, the amount to be blended is preferably 0.2 part or greater, and particularly preferably 0.5 part or greater. When the amount to be blended is beyond the above range, the matrix 6 may be so hard that the feel at impact may not be improved even though the solid particles 7 are blended. In this respect, the amount to be blended is preferably 5.0 parts or less, and particularly preferably 4.0 parts or less.

The matrix 6 may be blended with a filler for the purpose of e.g., adjusting specific gravity. Examples of the suitable filler include inorganic salts such as zinc oxide, barium sulfate and calcium carbonate; and powder of highly dense metal such as tungsten and molybdenum. The amount of these fillers to be blended is determined ad libitum so that the intended specific gravity of the mid layer 3 can be accomplished. Preferable filler is zinc oxide because it serves not only as an agent for adjusting specific gravity but also as a crosslinking activator.

Various additives such as anti-aging agents, coloring agents, plasticizers, dispersant and the like may be blended at an appropriate amount to the matrix 6 as needed.

The solid particle 7 can be usually obtained by crosslinking of a rubber composition. For the solid particles 7, similar base rubbers to those used in the matrix 6 as described above can be used. Furthermore, similar crosslinking agents, fillers and other additives to those which may be blended in the matrix 6 as described above may be blended. The amount of the various additives to be blended is also determined similarly to the amount in the case of the matrix 6 as described above. The solid particles 7 may be obtained through crosslinking of a rubber composition in a mold having a cavity of which size being predetermined. Alternatively, the solid particles 7 may be obtained through grinding of a rubber block post crosslinking. In either case, crosslinking temperature is set to be from 130° C. to 180° C., with the crosslinking time period of from 10 minutes to 60 minutes.

The solid particles may be formed from a resin composition. In general, a thermoplastic resin is used. Illustrative examples of suitable thermoplastic resin include ionomer resins, polyesters, polyurethanes, polyolefins and thermoplastic polystyrene elastomers. Additives such as fillers, coloring agents and the like may be blended in the resin composition as needed. The solid particles 7 may be obtained through filling a resin composition into a mold having a cavity of which size being predetermined. Alternatively, the solid particles 7 may be obtained through grinding of a resin block.

Examples of the shape of the solid particles 7 include sphere, cube, rectangular solid and circular cylinder. In view of the formability of the mid layer 3, substantially spherical solid particle 7 is suitable. Specific gravity of the solid particle 17 is usually 0.8 or greater and 1.5 or less.

The mid layer 3 of which matrix 6 is composed of a crosslinked rubber is obtained by a compression molding method in which half shells are used. In this method, a half shell is formed from a rubber composition for the matrix having solid particles 7 dispersed therein, and a core 2 is covered by two half shells. Then, this core 2 and half shells are compressed and heated in a mold. By heating, a crosslinking reaction of the rubber takes place. The crosslinking temperature is set to be from 140° C. to 170° C., with the crosslinking time period of from 10 minutes to 40 minutes. The mid layer 3 may be formed by an injection molding method. The mid layer 3 of which matrix 6 is composed of a resin composition is also obtained by a compression molding method in which half shells are used, or an injection molding method.

The core 2 (see, FIG. 2) is usually composed of across linked rubber. For the core 2, similar base rubbers to those for the matrix 6 described above may be used. In addition, similar co-crosslinking agent and organic peroxide to those for use in the matrix 6 as described above may be blended. It is preferred that the amount of the co-crosslinking agent to be blended be 10 parts or greater and 50 parts or less per 100 parts of the base rubber. When the amount to be blended is less than the above range, the resilience performance of the golf ball 1 may become insufficient. In this respect, the amount to be blended is particularly preferably 15 parts or greater. When the amount to be blended is beyond the above range, the feel at impact of the golf ball 1 may be hard. In this respect, the amount to be blended is particularly preferably 45 parts or less.

The amount of the organic peroxide to be blended in the core 2 is preferably 0.1 part or greater and 3.0 parts or less per 100 parts of the base rubber. When the amount to be blended is less than the above range, the resilience performance of the golf ball 1 may become insufficient. In this respect, the amount to be blended is more preferably 0.3 parts or greater, and particularly preferably 0.5 parts or greater. When the amount to be blended is beyond the above range, the feel at impact of the golf ball 1 may be hard. In this respect, the amount to be blended is particularly preferably 2.5 parts or less.

The core 2 may be blended with a filler for the purpose of e.g., adjusting specific gravity. Examples of the suitable filler include inorganic salts such as zinc oxide, barium sulfate and calcium carbonate; and powder of highly dense metal such as tungsten and molybdenum. The amount of the filler to be blended is determined ad libitum so that the intended specific gravity of the core 2 can be accomplished. Preferable filler is zinc oxide because it serves not only as an agent for adjusting specific gravity but also as a crosslinking activator.

Various additives such as anti-aging agents, coloring agents, plasticizers, dispersant and the like may be blended at an appropriate amount to the core 2 as needed.

The core 2 can be obtained through placing a rubber composition into a cavity of a mold, followed by compression and heating. By heating, a crosslinking reaction of the rubber takes place. The crosslinking temperature is set to be from 140° C. to 180° C., with the crosslinking time period of from 10 minutes to 60 minutes. The diameter of the core 2 is generally 25 mm or greater and 41 mm or less, and particularly 27 mm or greater and 40 mm or less.

In general, the cover 4 is composed of a resin composition. Illustrative examples of particularly preferable base resins include ionomer resins and thermoplastic elastomers, and any mixture thereof may be used.

Of the ionomer resins, copolymers of α-olefin and α,β-unsaturated carboxylic acid having 3 to 8 carbon atoms in which part of the carboxylic acid is neutralized with a metal ion are suitable. As the α-olefin herein, ethylene and propylene are preferred. Acrylic acid and methacrylic acid are preferred as the α,β-unsaturated carboxylic acid. Metal ions for the neutralization include: alkaline metal ions such as sodium ion, potassium ion, lithium ion and the like; bivalent metal ions such as zinc ion, calcium ion, magnesium ion and the like; trivalent metal ions such as aluminum ion, neodymium ion and the like. The neutralization may also be carried out with two or more kinds of metal ions. In light of the resilience performance and durability of the golf ball 1, particularly suitable metal ions are sodium ion, zinc ion, lithium ion and magnesium ion.

Specific examples of suitable ionomer resin include "Himilan 1555", "Himilan 1557", "Himilan 1601", "Himilan 1605", "Himilan 1652", "Himilan 1705", "Himilan 1706", "Himilan 1707", "Himilan 1855", "Himilan 1856", trade names by Mitsui-Dupont Polychemical Co. Ltd.; "Surlyn® 9945", "Surlyn® 8945", "Surlyn® AD8511", "Surlyn® AD8512", trade names by Dupont; and "IOTEK 7010", "IOTEK 8000", trade names by Exxon Corporation. Two or more kinds of ionomer resins may be used in combination.

Preferable thermoplastic elastomers include thermoplastic polyurethane elastomers, thermoplastic polyamide elastomers, thermoplastic polyester elastomers, thermoplastic styrene elastomers, and thermoplastic elastomers having OH groups at their ends. Two or more thermoplastic elastomers may be used in combination. In light of the resilience performance of the golf ball 1, thermoplastic polyester elastomers and thermoplastic styrene elastomers are particularly suitable.

Thermoplastic styrene elastomers (thermoplastic elastomers containing styrene blocks) include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS).

Illustrative examples of thermoplastic polyurethane elastomers include "Elastolan", trade name by BASF Polyurethane Elastomers Co., Ltd., and more specifically, "Elastolan ET880" can be exemplified. Illustrative examples of thermoplastic polyamide elastomers include "Pebax®", trade name by Toray Industries, Inc., and more specifically, "Pebax® 2533" can be exemplified. Illustrative examples of thermoplastic polyester elastomers include "Hytrel®", trade name by Dupont-Toray Co., Ltd., and more specifically, "Hytrel® 3548" and "Hytrel® 4047" can be exemplified. Illustrative examples of thermoplastic styrene elastomers include "Rabalon®", trade name by Mitsubishi Chemical Corporation, and more specifically, "Rabalon® SR04" can be exemplified.

To a resin composition for use in the cover 4, a diene block copolymer may be blended. A diene block copolymer has a polymer block of which basis being a vinyl aromatic compound, and a polymer block of which basis being a conjugated diene compound. The diene block copolymer has double bonds derived from a conjugated diene compound. A partially hydrogenated diene block copolymer can be suitably employed.

Exemplary vinyl aromatic compounds that constitute the diene block copolymer include styrene, α-methylstyrene, vinyltoluene, p-t-butylstyrene and 1,1-diphenylstyrene, and one or more compounds are selected from these. Particularly, styrene is suitable. Exemplary conjugated diene compounds include butadiene, isoprene, 1,3-pentadiene and 2,3-dimethyl-1,3-butadiene, and one or more compounds are selected from these. Specifically, butadiene and isoprene, and a combination thereof are suitable.

Preferable diene block copolymer includes: those of which structure being SBS (styrene-butadiene-styrene) having polybutadiene blocks containing epoxy groups, and those of which structure being SIS (styrene-isoprene-styrene) having polyisoprene blocks containing epoxy groups. Illustrative examples of diene block copolymer include "Epofriend®", trade name by Daicel Chemical Industries, Ltd., and more specifically, "Epofriend® A1010" can be exemplified.

Coloring agents such as titanium dioxide, fillers such as barium sulfate, dispersant, anti-aging agents, ultraviolet absorbents, light stabilizers, fluorescent agents, fluorescent brightening agents and the like may be blended at an appropriate amount to the cover 4 as needed. The cover 4 may be blended with powder of highly dense metal such as tungsten and molybdenum for the purpose of adjusting specific gravity.

Thickness of the cover 4 is generally 0.5 mm or greater and 2.5 mm or less, and particularly, 1.0 mm or greater and 2.3 mm or less. In order to form the cover 4, known procedure such as a compression molding method, an injection molding method and the like may be employed. By providing a number of protrusions on the cavity face of a mold, dimples 5 having a reversed shape of such a protrusion are formed on the surface of the cover 4. The plane shape of the dimple 5 (i.e., the contour of the dimple 5 observed by viewing the center of the golf ball 1 at infinity) is usually circular, however, non-circular shape (e.g., ellipsoid, oval, polygon, star, tear drops and the like) is also permitted. Sectional shape of the circular dimple may be a single radius shape (i.e., circular-arc), or a double radius shape (i.e., dish-like). In view of the flight performance, total number of the dimples 5 is preferably from 250 to 540, and particularly preferably, from 300 to 450. In view of the flight performance, it is preferred that summation of volume of the dimples be 300 $mm^3$ or greater and 700 $mm^3$ or less and particularly preferably 400 $mm^3$ or greater and 600 $mm^3$or less. Volume of a dimple means volume of a space surrounded by the surface of a dimple 5 and a phantom spherical surface of the ball. In view of the flight performance, it is preferred that surface area occupation ratio of dimples 5 be 65% or greater and 90% or less, and particularly 70% or greater and 85% or less. The surface area occupation ratio means a percentage of the summation of plain area of the dimples 5 occupied in the surface area of the phantom spherical surface of the ball.

The amount of compressive deformation of the core 2 is preferably 3.0 mm or greater and 8.0 mm or less, and particularly preferably 3.5 mm or greater and 7.0 mm or less. The amount of compressive deformation of a spherical body composed of the core 2 and the mid layer 3 is preferably 3.0 mm or greater and 7.0 mm or less, and particularly preferably 3.5 mm or greater and 6.0 mm or less. The amount of compressive deformation of the golf ball 1 is preferably 2.8 mm or greater and 4.0 mm or less, and particularly preferably 3.0 mm or greater and 3.8 mm or less. In order to measure the amount of compressive deformation, a subject spherical body is first placed on a hard plate made of metal. Next, a cylinder made of metal gradually descends toward the spherical body, and thus the spherical body, which is intervened between the bottom face of the cylinder and the hard plate, is deformed. Then, a migration distance of the cylinder is measured, starting from the state in which initial load of 98 N is applied to the spherical body up to the state in which final load of 1274 N is applied thereto. This value of migration distance is referred to as an amount of compressive deformation.

The core 2 of the golf ball 1 depicted in FIG. 1 is composed of a single layer, however, a core composed of two or more layers may be employed. The cover 4 of the golf ball 1 depicted in FIG. 1 is composed of a single layer, however, a cover composed of two or more layers may also be employed. Another mid layer may be provided between the core 2 and the mid layer 3, and another mid layer may be provided between the mid layer 3 and the cover 4.

EXAMPLES

[Manufacture of Solid Particle C3]

A rubber composition was obtained by kneading 100 parts of polybutadiene (trade name "BR11" from JSR Corporation), 22 parts of zinc acrylate, 10 parts of zinc oxide and 1.0 part of dicumyl peroxide in an internal kneading machine. This rubber composition was placed in a mold, and kept at 155° C. for 20 minutes to obtain a crosslinked molded piece in a sheet form. Hardness Hg of this crosslinked molded piece was 41. This crosslinked molded piece was grinded in a grinding machine, and then the particles were sorted with a sieve to obtain solid particles C3 having a particle size D of 0.7 mm.

[Manufacture of Solid Particles C1, C2 and C4]

In a similar manner to that for C3 except that the particle size D was changed as shown in Table 1 below, solid particles C1, C2 and C4 were obtained.

[Manufacture of Solid Particles A, B, D and F]

In a similar manner to that for C3 except that the constituents of the rubber composition were as shown in Table 1 below, solid particles A, B, D and F were obtained.

[Manufacture of Solid Particle E]

In a similar manner to that for C3 except that a crosslinked molded piece was obtained through injecting a thermoplastic polyurethane elastomer ("Elastolan ET880" described above) to a mold, a solid particle E was obtained.

TABLE 1

| | Constitution of solid particle | | | | | | | | |
|---|---|---|---|---|---|---|---|---|---|
| Number | A | B | C1 | C2 | C3 | C4 | D | E | F |
| polybutadiene | 100 | 100 | 100 | 100 | 100 | 100 | 100 | — | 100 |
| zinc acrylate | 32 | 26 | 22 | 22 | 22 | 22 | 18 | — | — |
| zinc oxide | 10 | 10 | 10 | 10 | 10 | 10 | 10 | — | — |
| magnesium methacrylate | — | — | — | — | — | — | — | — | 20 |
| magnesium oxide | — | — | — | — | — | — | — | — | 25 |
| dicumyl peroxide | 1.0 | 1.0 | 1.0 | 1.0 | 1.0 | 1.0 | 1.0 | | 1 |
| thermoplastic elastomer | — | — | — | — | — | — | — | 100 | — |
| hard Hg (shore D) | 53 | 46 | 41 | 41 | 41 | 41 | 36 | 28 | 20 |
| particle size D (mm) | 0.7 | 0.7 | 0.2 | 0.5 | 0.7 | 0.9 | 0.7 | 0.7 | 0.7 |

Example 1

A rubber composition was obtained by kneading 100 parts of polybutadiene ("BR11" described above), 24 parts of zinc acrylate, 10 parts of zinc oxide, 1.0 part of dicumyl peroxide and an appropriate amount of barium sulfate in an internal kneading machine. This rubber composition was placed in a mold having a spherical cavity, and kept at 155° C. for 30 minutes to obtain a core having a diameter of 34.8 mm. To make the weight of the golf ball 45.4 g, the amount of barium sulfate blended was adjusted.

Next, a rubber composition was obtained by kneading 100 parts of polybutadiene ("BR11" described above), 30 parts of zinc acrylate, 20 parts of zinc oxide and 0.8 part of dicumyl peroxide in an internal kneading machine, and by further kneading after placing 20 parts (11.7% by weight) of the solid particle C3 (hardness: 41, particle size D: 0.7). This rubber composition was placed into a mold and compressed to give a half shell. The core was covered by two of the half shells. The core and the half shells were placed into a mold followed by keeping at 155° C. for 20 minutes to form a mid layer composed of a matrix and solid particles. Thickness T of the mid layer was 2.0 mm; diameter of a spherical body composed of the core and the mid layer was 38.8 mm; hardness Hm of the matrix was 51; difference of both hardness (Hm−Hg) was 10; and ratio "D/T" was 0.35.

Next, 50 parts of an ionomer resin ("Himilan1605" described above), 50 parts of another ionomer resin ("Himilan 1706" described above), 2 parts of titanium oxide and 2 parts of barium sulfate were kneaded to give a resin composition. On the other hand, the core was placed into a mold having a spherical cavity, and thereafter the resin composition that had been melted by heating was injected around the core to form a cover having thickness of 2 mm. Hardness (Shore D) of this cover was 63. Coating was executed around this cover, and thus a golf ball of Example 1 was obtained.

Examples 4 to 7

In a similar manner to Example 1, golf balls of Examples 4 to 7 were obtained except that the amount of the solid particle C3 blended was as shown in Tables 2 and 3 below.

Examples 3 and 8, and Comparative Example 2

In a similar manner to Example 1, golf balls of Examples 3 and 8, and Comparative Example 2 were obtained except that solid particles (C1, C2 and C4) having altered particle size D were used.

Examples 2, 9, 10 and 11, and Comparative Example 1

In a similar manner to Example 1, golf balls of Examples 2, 9, 10 and 11, and Comparative Example 1 were obtained except that solid particles (A, B, D, E and F) having altered hardness Hg were used.

Comparative Example 3

In a similar manner to Example 1, a golf ball of Comparative Example 3 was obtained except that no solid particle was blended.

[Measurement of Resilience Coefficient]

To the golf ball, was impacted a hollow cylinder made of aluminum of which weight being 200 g at a velocity of 40 m/s. Then, velocity of the hollow cylinder prior to and after the impact, and the velocity of the golf ball after the impact were measured. Thus, a resilience coefficient was determined in accordance with law of conservation of momentum. Mean values of data which resulted from 12 times measurement are shown in Table 2 and Table 3 below as indices on the basis of the resilience coefficient of the golf ball of Example 1 which was converted to be 1.00.

[Travel Distance Test]

A driver with a metal head was equipped with a swing machine (True Temper Co.). Then the machine was conditioned to give a head speed of 40 m/s, and golf balls were hit therewith. Thereafter, travel distance (i.e., the distance from the launching point to the point where the ball stopped) was measured. Mean values of data which resulted from 5 times measurement are shown in Table 2 and Table 3 below.

[Evaluation of Feel at Impact]

Using a driver with a metal head, golf balls according to each of the Examples and Comparative Examples respectively were hit by 10 senior golfers. Thus, the feel at impact was evaluated. Those which were evaluated as satisfactory in the feel at impact by 8 or more golfers among the ten golfers were assigned "A", those which were evaluated as satisfactory by from 6 to 7 golfers were assigned "B", those which were evaluated as satisfactory by from 4 to 5 golfers were assigned "C", and those which were evaluated as satisfactory by 3 or less golfers were assigned "D". The results are presented in Table 2 and Table 3 below.

TABLE 2

Results of Evaluation

| | | Com. Exam. 1 | Example 2 | Com. Exam. 2 | Example 3 | Example 4 | Example 1 | Example 5 |
|---|---|---|---|---|---|---|---|---|
| solid | Type | A | B | C1 | C2 | C3 | C3 | C3 |
| particle | hardness Hg (shore D) | 53 | 46 | 41 | 41 | 41 | 41 | 41 |
| | particle size D (mm) | 0.7 | 0.7 | 0.2 | 0.5 | 0.7 | 0.7 | 0.7 |
| | blended amount (parts) | 20 | 20 | 20 | 20 | 5 | 20 | 45 |
| | blended amount (% by weight) | 11.7 | 11.7 | 11.7 | 11.7 | 3.2 | 11.7 | 23.0 |
| matrix hardness Hm (shore D) | | 51 | 51 | 51 | 51 | 51 | 51 | 51 |
| difference of hardness (Hm − Hg) | | −2 | 5 | 10 | 10 | 10 | 10 | 10 |
| ratio (D/T) | | 0.35 | 0.35 | 0.10 | 0.25 | 0.35 | 0.35 | 0.35 |
| resilience coefficient | | 1.02 | 1.01 | 1.00 | 1.00 | 1.01 | 1.00 | 0.99 |
| travel distance (m) | | 203.0 | 202.0 | 201.5 | 201.5 | 202.0 | 201.5 | 201.0 |
| feel at impact | | D | B | C | A | B | A | A |

TABLE 3

Results of Evaluation

| | | Example 6 | Example 7 | Example 8 | Example 9 | Example 10 | Example 11 | Com. Exam. 3 |
|---|---|---|---|---|---|---|---|---|
| solid particle | Type | C3 | C3 | C4 | D | E | F | — |
| | hardness Hg (shore D) | 41 | 41 | 41 | 36 | 28 | 20 | — |
| | particle size D (mm) | 0.7 | 0.7 | 0.9 | 0.7 | 0.7 | 0.7 | — |
| | blended amount (parts) | 70 | 130 | 20 | 20 | 20 | 20 | 0 |
| | blended amount (% by weight) | 31.7 | 46.2 | 11.7 | 11.7 | 11.7 | 11.7 | 0 |
| matrix hardness Hm (shore D) | | 51 | 51 | 51 | 51 | 51 | 51 | 51 |
| difference of hardness (Hm − Hg) | | 10 | 10 | 10 | 15 | 23 | 31 | — |
| ratio (D/T) | | 0.35 | 0.35 | 0.45 | 0.35 | 0.35 | 0.35 | — |
| resilience coefficient | | 0.99 | 0.97 | 1.00 | 0.99 | 0.99 | 0.98 | 1.01 |
| travel distance (m) | | 200.5 | 199.0 | 201.0 | 201.0 | 200.5 | 200.0 | 202.0 |
| feel at impact | | A | A | A | A | A | A | D |

From the comparison of Examples 1, 4, 5, 6 and 7, and Comparative Example 3, it is found that preferable range of the proportion of the solid particles occupied in the mid layer is 3% by weight or greater and 40% by weight or less. From the comparison of Examples 1, 3 and 8, and Comparative Example 2, it is found that necessary particle size D of the solid particles is 0.5 mm or greater. From the comparison of Examples 1, 2, 9, 10 and 11, and Comparative Example 1, it is found that necessary difference of the hardness (Hm−Hg) is 5 or greater. Accordingly, advantages of the present invention are clearly indicated by these results of evaluation.

The description herein above is merely for illustrative examples, and therefore, various modifications can be made without departing from the principles of the present invention.

What is claimed is:

1. A golf ball having a core, a mid layer and a cover, wherein said mid layer comprises a matrix of which base material is a rubber or a synthetic resin, and solid particles which are dispersed in said matrix and have a particle size D of 0.5 mm or greater, and when it is assumed that Shore D hardness of said matrix be Hm and Shore D hardness of said solid particles be Hg, a value (Hm−Hg) is 5 or greater, and wherein said core is formed of a matrix having no solid particles.

2. The golf ball according to claim 1, wherein a ratio D/T of the particle size D of said solid particle to the thickness T of the mid layer is 0.1 or greater.

3. The golf ball according to claim 1, wherein the weight percentage of the solid particles in the mid layer is from 3% by weight or greater to 40% by weight or less of the total weight of the solid particles in the mid layer and the matrix in the mid layer.

4. The golf ball according to claim 1, wherein Shore D hardness Hm of said matrix is 30 or greater.

5. The golf ball according to claim 4, wherein Shore D hardness Hg of said solid particles is 40 or less.

6. The golf ball according to claim 1, wherein Shore D hardness Hg of said solid particles is 40 or less.

7. A golf ball having a core, a mid layer and a cover, wherein said mid layer comprises a matrix of which base material is a rubber or a synthetic resin, and solid particles which are dispersed in said matrix and have a particle size D of 0.5 mm or greater, and when it is assumed that Shore D hardness of said matrix be Hm and Shore D hardness of said solid particles be Hg, a value (Hm−Hg) is 5 or greater, and wherein said core is formed of a matrix having no solid particles and said core has an amount of compressive deformation of between 3.0 mm and 8.0 mm.

* * * * *